US009006647B2

(12) United States Patent
Kenny et al.

(10) Patent No.: US 9,006,647 B2
(45) Date of Patent: Apr. 14, 2015

(54) MASS SPECTROMETER

(71) Applicant: Micromass UK Limited, Manchester (GB)

(72) Inventors: Daniel James Kenny, Knutsford (GB); Robert Harold Bateman, Cheshire (GB); Martin Raymond Green, Bowdon (GB); Jason Lee Wildgoose, Stockport (GB); Steven Derek Pringle, Darwen (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 14/156,838

(22) Filed: Jan. 16, 2014

(65) Prior Publication Data

US 2014/0131566 A1 May 15, 2014

Related U.S. Application Data

(63) Continuation of application No. 12/445,774, filed as application No. PCT/GB2007/003937 on Oct. 16, 2007, now Pat. No. 8,633,435.

(60) Provisional application No. 60/866,305, filed on Nov. 17, 2006.

(30) Foreign Application Priority Data

Oct. 16, 2006 (GB) ..... 0620468.9
Nov. 17, 2006 (GB) ..... 0622966.0

(51) Int. Cl.
*H01J 49/42* (2006.01)
*H01J 49/00* (2006.01)
*H01J 49/06* (2006.01)
*H01J 49/34* (2006.01)

(52) U.S. Cl.
CPC ..... *H01J 49/005* (2013.01); *H01J 49/0045* (2013.01); *H01J 49/065* (2013.01); *H01J 49/4235* (2013.01); *H01J 49/0031* (2013.01); *H01J 49/004* (2013.01); *H01J 49/34* (2013.01)

(58) Field of Classification Search
CPC ... H01J 49/005; H01J 49/004; H01J 49/0045; H01J 49/0081
USPC ..... 250/281–300
See application file for complete search history.

(56) References Cited

U.S. PATENT DOCUMENTS 5,206,506 A 4/1993 Kirchner
6,093,929 A 7/2000 Javahery et al.
6,525,312 B1 2/2003 Cousins (Continued)

FOREIGN PATENT DOCUMENTS

JP 2004349144 12/2004

*Primary Examiner* — Jack Berman
(74) *Attorney, Agent, or Firm* — Diederiks & Whitelaw, PLC

(57) ABSTRACT

A collision or fragmentation cell is disclosed comprising a plurality of electrodes wherein a first RF voltage is applied to an upstream group of electrodes and a second different RF voltage is applied to a downstream group of electrodes. The radial confinement of parent ions entering the collision or fragmentation cell is optimized by the first RF voltage applied to the upstream group of electrodes and the radial confinement of daughter or fragment ions produced within the collision or fragmentation cell is optimized by the second different RF voltage applied to the downstream group of electrodes.

6 Claims, 2 Drawing Sheets

(56) References Cited

U.S. PATENT DOCUMENTS

| | | | | |
|---|---|---|---|---|
| 6,534,764 | B1 | 3/2003 | Verentchikov et al. | |
| 6,730,904 | B1 | 5/2004 | Wells | |
| 6,967,323 | B2 | 11/2005 | Hashimoto et al. | |
| 7,034,292 | B1 | 4/2006 | Whitehouse et al. | |
| 7,102,129 | B2 * | 9/2006 | Schwartz | 250/292 |
| 7,405,401 | B2 | 7/2008 | Hoyes | |
| 7,615,742 | B2 | 11/2009 | Brekenfeld | |
| 7,932,488 | B2 | 4/2011 | Javahery et al. | |
| 8,097,844 | B2 | 1/2012 | Furuhashi et al. | |
| 2004/0051038 | A1 | 3/2004 | Taniguchi | |
| 2004/0195503 | A1 | 10/2004 | Kim et al. | |
| 2007/0164213 | A1 | 7/2007 | Javahery et al. | |
| 2010/0065737 | A1 | 3/2010 | Bateman et al. | |

* cited by examiner

MASS SPECTROMETER

CROSS REFERENCE TO RELATED APPLICATIONS

This application is a continuation of U.S. patent application Ser. No. 12/445,774 filed Aug. 17, 2010, which is the National Stage of International Application No PCT/GB2007/003937, filed Oct. 16, 2007, which claims benefit of and priority to U.S. Provisional Patent Application No. 60/866,305, filed on Nov. 17, 2006, United Kingdom Application No. 06020468.9 which was filed on Oct. 16, 2006 and United Kingdom Application No. 0622966.0 which was filed on Nov. 17, 2006. The contents of these applications are expressly incorporated herein by reference in their entirety.

BACKGROUND OF THE INVENTION

The present invention relates to a mass spectrometer and a method of mass spectrometry.

A tandem mass spectrometer is known which comprises an ion source, a mass filter which is arranged to transmit parent ions having a particular mass to charge ratio, a fragmentation cell arranged downstream of the mass filter which is arranged to fragment the parent ions transmitted by the mass filter, and a mass analyser which is arranged to mass analyse the fragment ions produced in the fragmentation cell. The fragmentation cell comprises a chamber wherein parent ions are arranged to undergo energetic collisions with gas molecules. However, the energetic collision of parent ions with gas molecules can cause parent ions to become scattered and this can cause parent ions to become lost prior to fragmentation. Fragment or product ions produced within the fragmentation cell may also become lost due to scattering effects. This can have the effect of lowering sensitivity.

It is known that an inhomogeneous RF electric field will direct ions to regions where the RF electric field is weakest. This characteristic is exploited in RF ion guides where the background gas pressure is sufficient to cause a significant number of ion-molecule collisions. A known RF ion guide comprises a plurality of rod electrodes arranged parallel to a central axis. An RF voltage is applied between neighbouring electrodes. The resulting radial RF electric field is weakest along the central axis and hence ions which are scattered as a result of ion-molecule collisions will tend to be re-directed back to the central axis of the RF ion guide. As a result ions are confined within the RF ion guide.

The known RF ion guide is commonly provided in the collision cell of a tandem mass spectrometer and selected parent or precursor ions are arranged to undergo collisions with gas molecules within the collision cell. The known RF ion guides have been shown to transmit ions with high efficiency in spite of ions undergoing a large number of collisions with background gas molecules.

The most common form of tandem mass spectrometer is known as a triple quadrupole mass spectrometer. A triple quadrupole mass spectrometer comprises an ion source, a first quadrupole mass filter, a gas collision cell comprising an RF quadrupole rod set ion guide, and a second quadrupole mass filter. Other arrangements are known wherein the collision cell may comprise a hexapole or octopole rod set ion guide or an ion tunnel ring stack ion guide.

The transmission characteristics of a RF ion guide is known to vary with the mass to charge ratio of the ions. For a given geometrical configuration and a given RF voltage and frequency there will be a range of mass to charge ratio values for which the radial confinement of the ions is relatively high and consequently the ion transmission efficiency is also relatively high. However, outside of this range the overall transmission efficiency of ions will be reduced.

The maximum instantaneous velocity of ions having relatively low mass to charge ratios is higher than that of ions having relatively high mass to charge ratios. As a consequence, ions having relatively low mass to charge ratios will follow trajectories with relatively large radial excursions and ions having mass to charge ratios below a certain critical value may strike the electrodes of the RF ion guide and hence become lost to the system. The critical mass to charge ratio below which ions may be lost in this way is generally known as the low mass to charge ratio cut off value. The ion transmission efficiency drops off rapidly for ions having mass to charge ratios below the low mass to charge ratio cut off value.

In a conventional gas collision cell ions undergo multiple energetic collisions with background gas molecules in order to induce fragmentation. Ions which are scattered due to these energetic collisions are confined about the central axis of the RF ion guide in spite of this scattering process. However, for a given RF voltage and frequency the time averaged or effective radial confining force due to the inhomogeneous RF field decreases with mass to charge ratio. As a consequence, ions having relatively high mass to charge ratios and which are scattered are less effectively confined by the RF ion guide and the ion transmission efficiency starts to decrease with increasing mass to charge ratio. In this case the ion transmission efficiency drops off only gradually with increasing mass to charge ratio value.

As a consequence of these two considerations there is an optimum range of RF voltages for a given RF frequency and geometrical configuration of the RF ion guide for which energetic ions are efficiently transmitted through and radially confined within the gas collision cell. Alternatively, for a given RF voltage and frequency and a given geometrical configuration of the RF ion guide, there is a limited range of mass to charge ratios for which energetic ions are efficiently transmitted through the gas collision cell.

A problem with a conventional gas collision cell is that parent or precursor ions which initially enter the collision cell will have a first relatively high mass to charge ratio whereas the resulting product or fragment ions formed in the gas cell (and which subsequently exit the gas collision cell) will have a second relatively low mass to charge ratio. If the mass to charge ratios of the parent or precursor ions and the product or fragment ions are substantially different, then the optimum range of RF voltages required for efficient transmission of the two different groups of ions will be substantially different and the two ranges may not overlap. As a result, neither the parent or precursor ions nor the product or fragment ions will be transmitted with high efficiency.

It is desired to provide an improved mass spectrometer.

SUMMARY OF THE INVENTION

According to an aspect of the present invention there is provided a mass spectrometer comprising:

a collision, fragmentation or reaction device, the collision, fragmentation or reaction device comprising a plurality of electrodes comprising at least a first section comprising a first group of electrodes and a second separate section comprising a second separate group of electrodes;

a first device for applying or supplying a first AC or RF voltage having a first frequency and a first amplitude to the first group of electrodes so that, in use, ions having a first mass to charge ratio experience a first radial pseudo-potential electric field or force having a first strength or magnitude which acts to confine ions radially within the first group of electrodes or the first section; and a second device for applying or supplying a second AC or RF voltage having a second frequency and a second amplitude to the second group of electrodes so that, in use, ions having the first mass to charge ratio experience a second radial pseudo-potential electric field or force having a second strength or magnitude which acts to confine ions radially within the second group of electrodes or the second section, wherein the second strength or magnitude is different to the first strength or magnitude.

The first AC or RF voltage is preferably applied to the first group of electrodes but is not applied to the second group of the electrodes.

The second AC or RF voltage is preferably applied to the second group of electrodes but is not applied to the first group of electrodes.

The mass spectrometer preferably further comprises a first AC or RF voltage generator for generating the first AC or RF voltage and a second separate AC or RF voltage generator for generating the second AC or RF voltage.

Alternatively, the mass spectrometer may comprise a single AC or RF generator. The mass spectrometer preferably further comprises one or more attenuators wherein an AC or RF voltage emitted from the single AC or RF generator and transmitted to the first device and/or the second device is arranged to pass through the one or more attenuators.

The first group of electrodes is preferably arranged upstream of the second group of electrodes.

The first group of electrodes preferably comprises: (i) <5 electrodes; (ii) 5-10 electrodes; (iii) 10-15 electrodes; (iv) 15-20 electrodes; (v) 20-25 electrodes; (vi) 25-30 electrodes; (vii) 30-35 electrodes; (viii) 35-40 electrodes; (ix) 40-45 electrodes; (x) 45-50 electrodes; (xi) 50-55 electrodes; (xii) 55-60 electrodes; (xiii) 60-65 electrodes; (xiv) 65-70 electrodes; (xv) 70-75 electrodes; (xvi) 75-80 electrodes; (xvii) 80-85 electrodes; (xviii) 85-90 electrodes; (xix) 90-95 electrodes; xx) 95-100 electrodes; des; and (xxi) >100 electrodes.

The axial length or thickness of at least 1%, 5%, 10%, 20%, 30%, 40%, 50%, 60%, 70%, 80%, 90%, 95% or 100% of the electrodes in the first group of electrodes is preferably selected from the group consisting of: (i) <1 mm; (ii) 1-2 mm; (iii) 2-3 mm; (iv) 3-4 rum; (v) 4-5 mm, (vi) 5-6 mm; (vii) 6-7 mm; (viii) 7-8 mm; (ix) 8-9 mm; (x) 9-10 mm; (xi) 10-11 man; (xii) 11-12 mm; (xiii) 12-13 mm; (xiv) 13-14 mm; (xv) 14-15 mm; (xvi) 15-16 mm; (xvii) 16-17 mm; (xviii) 17-18 mm; (xix) 18-19 mm; (xx) 19-20 mm; and (xxi) >20 mm.

The axial spacing between at least 1%, 5%, 10%, 20%, 30%, 40%, 50%, 60%, 70%, 80%, 90%, 95% or 100% of the electrodes in the first group of electrodes is preferably selected from the group consisting of; (i) <1 mm; (ii) 1-2 mm; (iii) 2-3 mm; (iv) 3-4 trim; (v) 4-5 mm; (vi) 5-6 mm; 6-7 mm; (iii) 7-8 mm; (ix) 8-9 mm; (x) 9-10 mm; (xi) 10-11 mm; (xii) 11-12 mm; (xiii) 12-13 mm; (xiv) 13-14 mm; (xv) 14-15 mm; (xvi) 15-16 mm; (xvii) 16-17 mm; (xviii) 17-18 mm; (xix) 18-1.9 mm; (xx) 19-20 mm; and (xxi) >20 mm.

Axially adjacent electrodes within the first group of electrodes are preferably supplied with opposite phases of the first AC or RF voltage.

The first AC or RF voltage preferably has a first amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; (xi) 500-550 V peak to peak; (xii) 550-600 V peak to peak; (xiii) 600-650 V peak to peak; (xiv) 650-700 V peak to peak; (xv) 700-750 V peak to peak; (xvi) 750-800 V peak to peak; (xvii) 800-830 V peak to peak; (xviii) 850-900 V peak to peak; (xix) 900-950 V peak to peak; (xx) 950-1000 V peak to peak; and (xxi) >1000 V peak to peak.

The first AC or RF voltage preferably has a first frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxi) 8.5-9.0 MHz; (xxiii) 9.0-9.5 MHz; (xxiv) 9.5-10.0 MHz; and (xxv) >10.0 MHz.

The second group of electrodes preferably comprises: (i) <5 electrodes; (ii) 5-10 electrodes; (iii) 10-15 electrodes; (iv) 15-20 electrodes; (v) 20-25 electrodes; (vi) 25-30 electrodes; (vh) 30-35 electrodes; (viii) 35-40 electrodes; (ix) 40-45 electrodes; (x) 45-50 electrodes; (xi) 50-55 electrodes; (xii) 55-60 electrodes; (xiii) 60-65 electrodes; (xiv) 65-70 electrodes; (xv) 70-75 electrodes; (xvi) 75-80 electrodes; (xvii) 80-85 electrodes; (xviii) 85-90 electrodes; (xix) 90-95 electrodes; (xx) 95-100 electrodes; and (xxi) >100 electrodes.

The axial length or thickness of at least 1%, 5%, 10%, 20%, 30%, 40%, 50%, 60%, 70%, 80%, 90%, 95% or 100% of the electrodes in the second group of electrodes is preferably selected from the group consisting of: (i) <1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; (xi) 10-11 mm; (xii) 11-12 mm; (xiii) 12-13 mm; (xiv) 13-14 mm; (xv) 14-15 mm, (xvi) 15-16 mm; (xvii) 16-17 mm; (xviii) 17-18 mm; (xix) 18-19 mm; (xx) 19-20 mm; and (xxi) >20 mm.

According to an embodiment the axial spacing between at least 1%, 5%, 10%, 20%, 30%, 40%, 50%, 60%, 70%, 80%, 90%, 95% or 100% of the electrodes in the second group of electrodes is selected from the group consisting of: (i) <1 mm (ii) 1-2 mm; (hi) 2-3 mm; (iv) 3-4 mm; (v) 4-5 turn, (vi) 5-6 mm; (vii) 6-7 mm; (viii) 7-8 mm; (ix) 8-9 mm; (x) 9-10 mm; (xi) 10-11 mm; (xii) 11-12 mm; (xiii) 12-13 mm; (xiv) 13-14 mm; (xv) 14-15 mm; (xvi) 15-16 mm; (xvii) 16-17 mm; (xviii) 17-18 mm; (xix) 18-19 mm; (xx) 19-20 mm; and (xxi) >20 mm.

Axially adjacent electrodes within the second group of electrodes are preferably supplied with opposite phases of the second AC or RF voltage.

The first section preferably has an axial length $x_{first}$ and the overall axial length of the collision, fragmentation or reaction device is L and wherein the ratio $x_{first}/L$ is preferably selected from the group consisting of: (i) <0.05; (ii) 0.05-0.10; (iii) 0.10-0.15; (iv) 0.15-0.20; (v) 0.20-0.25; (vi) 0.25-0.30; (vii) 0.30-0.35; (viii) 0.35-0.40; (ix) 0.40-0.45; (x) 0.45-0.50; (xi) 0.50-0.55; (xii) 0.55-0.60; (xiii) 0.60-0.65; (xiv) 0.65-0.70; (xv) 0.70-0.75; (xvi) 0.75-0.80; (xvii) 0.80-0.85; (xviii) 0.85-0.90; (xix) 0.90-0.95; and (xx) >0.95.

The second section preferably has an axial length $x_{second}$ and the overall axial length of the collision, fragmentation or reaction device is L and wherein the ratio $x_{second}/L$ is preferably selected from the group consisting of: (i) <0.05; (ii) 0.05-0.10; (iii) 0.10-0.15; (iv) 0.15-0.20; (v) 0.20-0.25; (vi) 0.25-0.30; (vii) 0.30-0.35; (viii) 0.35-0.40; (ix) 0.40-0.45; (x) 0.45-0.50; (xi) 0.50-0.55; (xii) 0.55-0.60; (xiii) 0.60-0.65; (xiv) 0.65-0.70; (xv) 0.70-0.75; (xvi) 0.75-0.80; (xvii) 0.80-0.85; (xviii) 0.85-0.90; (xix) 0.90-0.95; and (xx) >0.95.

According to an embodiment the second AC or RF voltage preferably has a second amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; (xi) 500-550 V peak to peak; (xii) 550-600 V peak to peak; (xiii) 600-650 V peak to peak; (xiv) 650-700 V peak to peak; (xv) 700-750 V peak to peak; (xvi) 750-800 V peak to peak; (xvii) 800-850 V peak to peak; (xviii) 850-900 V peak to peak; (xix) 900-950 V peak to peak; (xx) 950-1000 V peak to peak; and (xxi) >1000 V peak to peak.

The second AC or RF voltage preferably has a second frequency selected from the group consisting of: (i) <100 kHz; (ii) 100-200 kHz, (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz, (xvii) 6.0-6.5 MHz; (xviii) 6.5-7.0 MHz; (xix) 7.0-7.5 MHz; (xx) 7.5-8.0 MHz; (xxi) 8.0-8.5 MHz; ((xii) 8.5-9.0 MHz; (xxiii) 9.0-9.5 MHz; (xxiv) 9.5-10.0 MHz; and (xxv) >10.0 MHz.

According to an embodiment the phase difference between the first AC or RF voltage and the second AC or RF voltage is preferably selected from the group consisting of: (i) 0-10°; (ii) 10-20°; (iii) 20-30°; (iv) 30-40°; (v) 40-50°; (vi) 50-60°; (vii) 60-70°; (viii) 70-80°; (ix) 80-90°; (x) 90-100°; (xi) 100-110°; (xii) 110-120°; (xiii) 120-130°; (xiv) 130-140°; (xv) 140-150°; (xvi) 150-160°; (xvii) 160-170°; (xviii) 170-180°; (xix) 180-190°; (xx) 190-200°; (xxi) 200-210°; (xxii) 210-220°; (xxiii) 220-230°; (xxiv) 230-240°; (xxv) 240-250°; (xxi) 250-260; (xxvii) 260-270°; (xxviii) 270-280°; (xxix) 280-290°; (xxx) 290-300°; (xxxi) 300-310°; (xxxii) 310-320°; (xxxiii) 320-330°; (xxxiv) 330-340°; (xxxv) 340-350°; (xxxvi) 350-360°; and (xxxvii) 0°.

According to an embodiment the first frequency is preferably the substantially the same as the second frequency. According to a less preferred embodiment the first frequency may be substantially different from the second frequency.

The first amplitude is preferably substantially different from the second amplitude. According to a less preferred embodiment the first amplitude may be substantially the same as the second amplitude.

The collision, fragmentation or reaction device preferably further comprises a third section comprising a third group of electrodes. The third group of electrodes is preferably separate to the first group of electrodes and is preferably separate to the second group of electrodes.

The third group of electrodes is preferably arranged intermediate the first group of electrodes and the second group of electrodes.

According to an embodiment the mass spectrometer further comprises a third device for applying or supplying a third AC or RU voltage having a third frequency and a third amplitude to the third group of electrodes so that, in use, ions having the first mass to charge ratio experience a third radial pseudo-potential electric field or force having a third strength or magnitude which acts to confine ions radially within the third group of electrodes or the third section. The third strength or magnitude is preferably different to the first strength or magnitude and/or the second strength or magnitude.

The third AC or RF voltage is preferably applied to the third group of electrodes but is preferably not applied to the first group of electrodes and/or the second group of electrodes.

The mass spectrometer preferably further comprises a third AC or RF voltage generator for generating the third AC or RF voltage. According to a less preferred embodiment the mass spectrometer may comprise a single AC or RF generator and wherein the mass spectrometer further comprises one or more attenuators. An AC or RF voltage emitted from the single AC or RF generator and transmitted to the first device and/or the second device and/or the third device is preferably arranged to pass through the one or more attenuators.

The third group of electrodes preferably comprises: (i) <5 electrodes; (ii) 5-10 electrodes; (iii) 10-15 electrodes; (iv) 15-20 electrodes; (v) 20-25 electrodes; (vi) 25-30 electrodes; (vii) 30-35 electrodes; (viii) 35-40 electrodes; (ix) 410-45 electrodes; (x) 45-50 electrodes; (xi) 50-55 electrodes; (xii) 55-60 electrodes; (xiii) 60-65 electrodes; (xiv) 65-70 electrodes; (xv) 70-75 electrodes; (xvi) 75-80 electrodes; (xvii) 80-85 electrodes; (xviii) 85-90 electrodes; (xix) 90-95 electrodes; (xx) 95-100 electrodes; and (xxi) >100 electrodes.

The axial length or thickness of at least 1%, 5%, 10%, 20%, 30%, 40%, 50%, 60%, 70%, 80%, 90%, 95% or 100% of the electrodes in the third group of electrodes is preferably selected from the group consisting of: (i) <1 mm; (ii) 1-2 mm, (iii) 2-3 mm (iv) 3-4 mm; (v) 4-5 mm; (vi) 5-6 mm; (vii) 6-7 mm; (viii) 7-8 mm; (ix) 8-9 mm; (x) 9-10 mm; (xi) 10-11 mm; (xii) 11-12 rum; (xiii) 12-13 mm (xiv) 13-14 mm; (xv) 14-15 mm; (xvi) 15-16 mm; (xvii) 16-17 mm; (xviii) 17-1.8 mm; (xix) 18-19 mm; (xx) 19-20 mm; and (xxi) >20 mm.

The axial spacing between at least 1%, 5%, 10%, 20%, 30%, 40%, 50%, 60%, 70%, 80%, 90%, 95% or 100% of the electrodes in the third group of electrodes is preferably selected from the group consisting of: (i) <1 mm; (ii) 1-2 mm; (iii) 2-3 mm; (iv) 3-4 mm; (v) 4-5 mm; (vi) 5-6 mm; (vii) 6-7 mm; (viii) 7-8 mm; 8-9 mm; (x) 9-10 mm, (xi) 10-11 mm; (xii) 11-12 mm; (xiii) 12-13 mm; (xiv) 13-14 mm; (xv) 14-15 mm; (xvi) 15-16 mm; (xvii) 16-17 mm; (xviii) 17-18 mm; (xix) 18-19 mm; (xx) 19-20 mm; and (xxi) >20 mm.

Axially adjacent electrodes within the third group of electrodes are preferably supplied with opposite phases of the third AC or RF voltage.

The third section preferably has an axial length $x_{third}$ and the overall axial length of the collision, fragmentation or reaction device is L and wherein the ratio $x_{third}/L$ is preferably selected from the group consisting of: (i) <0.05; (ii) 0.05-0.10; (iii) 0.10-0.15; (iv) 0.15-0.20; (v) 0.20-0.25; (vi) 0.25-0.30; (vii) 0.30-0.35; (viii) 0.35-0.40; (ix) 0.40-0.45; (x) 0.45-0.50; (xi) 0.50-0.55; (xii) 0.55-0.60; (xiii) 0.60-0.65; (xiv) 0.65-0.70; (xv) 0.70-0.75; (xvi) 0.75-0.80; (xvii) 0.80-0.85; (xviii) 0.85-0.90; (xix) 0.90-0.95; and (xx) >0.95.

According to an embodiment the third AC or RF voltage preferably has a third amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; (xi) 500-550 V peak to peak; (xii) 550-600 V peak to peak; (xiii) 600-650 V peak to peak; (xiv) 650-700 V peak to peak; (xv) 700-750 V peak to peak; (xvi) 750-800 V peak to peak; (xvii) 800-850 V peak to peak; (xviii) 850-900 V peak to peak; (xix) 900-950 V peak to peak; (xx) 950-1000 V peak to peak, and (xxi) >1000 V peak to peak.

The third AC or RF voltage preferably has a third frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz (viii) 1.5-2.0 MHz; (ix) 2.0-2.5 MHz; (x) 2.5-3.0 MHz; (xi) 3.0-3.5 MHz, (xii) 3.5-4.0 MHz; (xiii) 40-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

According to an embodiment the collision, fragmentation or reaction device preferably comprises n sections, wherein each section comprises one or more electrodes and wherein the amplitude and/or frequency and/or phase difference of an AC or RF voltage applied to the sections in order to confine ions radially, in use, within the collision, fragmentation or reaction device progressively increases, progressively decreases, linearly increases, linearly decreases, increases in a stepped, progressive or other manner, decreases in a stepped, progressive or other manner, increases in a non-linear manner or decreases in a non-linear manner along the axial length of the collision, fragmentation or reaction device.

The collision, fragmentation or reaction device is preferably arranged and adapted so that the pseudo-potential electric field or force which acts to confine ions radially, in use, within the collision, fragmentation or reaction device progressively increases, progressively decreases, linearly increases, linearly decreases, increases in a stepped, progressive or other manner, decreases in a stepped, progressive or other manner, increases in a non-linear manner or decreases in a non-linear manner along the axial length of the collision, fragmentation or reaction device.

The collision, fragmentation or reaction device is preferably arranged and adapted to fragment ions by Collision Induced Dissociation ("CID"). According to less preferred embodiments the collision, fragmentation or reaction device may be selected from the group consisting of: (i) a Surface Induced Dissociation ("SID") le fragmentation device; (ii) an Electron Transfer Dissociation fragmentation device; (iii) an Electron Capture Dissociation fragmentation device; (iv) an Electron Collision or Impact Dissociation fragmentation device; (v) a Photo Induced Dissociation ("PID") fragmentation device; (vi) a Laser Induced Dissociation fragmentation device; (vii) an infrared radiation induced dissociation device; (viii) an ultraviolet radiation induced dissociation device; (ix) a nozzle-skimmer interface fragmentation device; (x) an in-source fragmentation device; (xi) an ion-source Collision Induced Dissociation fragmentation device; (xii) a thermal or temperature source fragmentation device; (xiii) an electric field induced fragmentation device; (xiv) a magnetic field induced fragmentation device; (xv) an enzyme digestion or enzyme degradation fragmentation device; (xvi) an ion-ion reaction fragmentation device; (xvii) an ion-molecule reaction fragmentation device; (xviii) an ion-atom reaction fragmentation device; (xix) an ion-metastable ion reaction fragmentation device; (xx) an ion-metastable molecule reaction fragmentation device; (xxi) an ion-metastable atom reaction fragmentation device; (xxii) an ion-ion reaction device for reacting ions to form adduct or product ions; (xxiii) an ion-molecule reaction device for reacting ions to form adduct or product ions; (xxiv) an ion-atom reaction device for reacting ions to form adduct or product ions; (xxv) an ion-metastable ion reaction device for reacting ions to form adduct or product ions; (xxvi) an ion-metastable molecule reaction device for reacting ions to form adduct or product ions; and (xxvii) an ion-metastable atom reaction device for reacting ions to form adduct or product ions.

The collision, fragmentation or reaction device preferably comprises a plurality of electrodes having apertures through which ions are transmitted in use. At least 1%, 5%, 10%, 20%, 30%, 40%, 50%, 60%, 70%, 80%, 90%, 95% or 100% of the electrodes preferably have substantially circular, rectangular, square or elliptical apertures.

At least 1%, 5%, 10%, 20%, 30%, 40%, 50%, 60%, 70%, 80%, 90%, 95% or 100% of the electrodes preferably have apertures which are substantially the same size or which have substantially the same area.

According to another embodiment at least 1%, 5%, 10%, 20%, 30%, 40%, 50%, 60%, 70%, 80%, 90%, 95% or 100% of the electrodes have apertures which become progressively larger and/or smaller in size or in area in a direction along the axis of the collision, fragmentation or reaction device.

At least 1%, 5%, 10%, 20%, 30%, 40%, 50%, 60%, 70%, 80%, 90%, 95% or 100% of the electrodes preferably have apertures having internal diameters or dimensions selected from the group consisting of: (i) ≤1.0 mm; (ii) ≤2.0 mm; (iii) ≤3.0 mm; (iv) ≤4.0 mm; (v) ≤5.0 mm; (vi) ≤6.0 mm; (vii) ≤7.0 mm; (viii) ≤8.0 mm; (ix) ≤9.0 mm; (x) ≤10.0 mm; and (xi) >10.0 mm.

According to an embodiment at least some of the plurality of electrodes comprise apertures and wherein the ratio of the internal diameter or dimension of the apertures to the centre-to-centre axial spacing between adjacent electrodes is selected from the group consisting of: (i) <1.0; (ii) 1.0-1.2; (iii) 1.2-1.4; (iv) 1.4-1.6; (v) 1.6-1.8; (vi) 1.8-2.0; (vii) 2.0-22; (viii) 2.2-2.4; (ix) 2.4-2.6; (x) 2.6-2.8; (xi) 2.8-3.0; (xii) 3.0-3.2; (xiii) 3.2-3.4; (xi) 3.4-3.6; (xv) 3.6-3.8; (xvi) 3.8-4.0; (xvii) 4.0-4.2; (xviii) 4.2-4.4; (xix) 4.4-4.6; (xx) 4.6-4.8; (xxi) 4.8-5.0; and (xxii) >5.0.

According to an embodiment the internal diameter of the apertures progressively increases, progressively decreases, linearly increases, linearly decreases, increases in a stepped, progressive or other manner, decreases in a stepped, progressive or other manner, increases in a non-linear manner or decreases in a non-linear manner along the axial length of the collision, fragmentation or reaction device.

According to an alternative embodiment the collision, fragmentation or reaction device may comprise a segmented rod set. The segmented rod set may comprise a segmented quadrupole, hexapole or octapole rod set or a rod set comprising more than eight segmented rods.

The collision, fragmentation or reaction device may comprise a plurality of electrodes having a cross-section selected from the group consisting of: (i) approximately or substantially circular cross-section; (ii) approximately or substantially hyperbolic surface; (iii) an arcuate or part-circular cross-section; (iv) an approximately or substantially rectangular cross-section; and (v) an approximately or substantially square cross-section.

According to another embodiment the collision, fragmentation or reaction device may comprise a plurality of groups of electrodes, wherein the groups of electrodes are axially spaced along the axial length of the collision, fragmentation or reaction device and wherein each group of electrodes comprises a plurality of plate electrodes.

According to an embodiment each group of electrodes comprises a first plate electrode and a second plate electrode, wherein the first and second plate electrodes are arranged substantially in the same plane and are arranged either side of the central longitudinal axis of the collision, fragmentation or reaction device.

The mass spectrometer preferably further comprises means for applying a DC voltage or potential to the first and second plate electrodes in order to confine ions in a first radial direction within the collision, fragmentation or reaction device.

Each group of electrodes preferably further comprises a third plate electrode and a fourth plate electrode, wherein the third and fourth plate electrodes are preferably arranged substantially in the same plane as the first and second plate electrodes and are arranged either side of the central longitudinal axis of the collision, fragmentation or reaction device in a different orientation to the first and second plate electrodes.

The first device for applying a first AC or RF voltage is preferably arranged to apply the first AC or RF voltage to at least 1%, 5%, 10%, 20%, 30%, 40%, 50%, 60%, 70%, 80%, 90% or 95% of the third and fourth plate electrodes in order to confine ions in a second radial direction within the collision, fragmentation or reaction device. The second radial direction is preferably orthogonal to the first radial direction.

The second device for applying a second AC or RF voltage is preferably arranged to apply the second AC or RF voltage to at least 1%, 5%, 10%, 20%, 30%, 40%, 50%, 60%, 70%, 80%, 90% or 95% of the third and fourth plate electrodes in order to confine ions in a second radial direction within the collision, fragmentation or reaction device. The second radial direction is preferably orthogonal to the first radial direction.

According to an embodiment the collision, fragmentation or reaction device comprises:

one or more first electrodes disposed on a first side;

one or more second electrodes disposed on a second side; and one or more layers of intermediate planar, plate or mesh electrodes arranged generally or substantially in a plane in which ions travel, in use, the one or more layers of intermediate planar, plate or mesh electrodes being arranged between the one or more first electrodes and the one or more second electrodes.

The one or more first electrodes preferably comprise an array of first electrodes.

The one or more second electrodes preferably comprise an array of second electrodes.

The one or more layers of intermediate planar, plate or mesh electrodes preferably comprise one or more layers of axially segmented electrodes.

The first device is preferably arranged to apply or supply the first AC or RF voltage to at least 1%, 5%, 10%, 20%, 30%, 40%, 50%, 60%, 70%, 80%, 90%, 95% of the one or more first electrodes disposed on the first side.

The first device is preferably arranged to apply or supply the first AC or RF voltage to at least 1%, 5%, 10%, 20%, 30%, 40%, 50%, 60%, 70%, 80%, 90%, 95% of the one or more second electrodes disposed on the second side.

The first device is preferably arranged to apply or supply the first AC or RF voltage to at least 1%, 5%, 10%, 20%, 30%, 40%, 50%, 60%, 70%, 80%, 90%, 95% of the one or more intermediate electrodes.

The second device is preferably arranged to apply or supply the second AC or RF voltage to at least %, 5%, 10%, 20%, 30%, 40%, 50%, 60%, 70%, 80%, 90%, 95% of the one or more first electrodes disposed on the first side.

The second device is preferably arranged to apply or supply the second AC or RF voltage to at least 1%, 5%, 10%, 20%, 30%, 40%, 50%, 60%, 70%, 80%, 90%, 95% of the one or more second electrodes disposed on the second side.

The second device is preferably arranged to apply or supply the second AC or RF voltage to at least 1%, 5%, 10%, 20%, 30%, 40%, 50%, 60%, 70%, 80%, 90%, 95% of the one or more intermediate electrodes.

The axial length and/or the centre to centre spacing of the electrodes may according to an embodiment be arranged to progressively increase, progressively decrease, linearly increase, linearly decrease, increase in a stepped, progressive or other manner, decrease in a stepped, progressive or other manner, increase in a non-linear manner or decrease in a non-linear manner along the axial length of the collision, fragmentation or reaction device.

The collision, fragmentation or reaction device may comprise n sections, wherein each section comprises one or more electrodes and wherein the amplitude and/or frequency and/or phase difference of an AC or RF voltage applied to the sections in order to confine ions radially within the collision, fragmentation or reaction device is arranged to progressively increase with time, progressively decrease with time, linearly increase with time, linearly decrease with time, increase in a stepped, progressive or other manner with time, decrease in a stepped, progressive or other manner with time, increase in a non-linear manner with time or decrease in a non-linear manner with time.

The collision, fragmentation or reaction device is preferably arranged and adapted so that the pseudo-potential electric field or force which acts to confine ions radially within the collision, fragmentation or reaction device is arranged to progressively increase with time progressively decrease with time linearly increase with time, linearly decrease with time, increase in a stepped, progressive or other manner with time, decrease in a stepped, progressive or other manner with time, increase in a non-linear manner with time or decrease in a non-linear manner with time.

The collision, fragmentation or reaction device preferably has an axial length selected from the group consisting of: (i) <20 mm; (ii) 20-46 mm; (iii) 40-60 mm; (iv) 60-80 mm; (v) 80-100 trim; (vi) 100-120 mm; (vii) 120-140 mm; (viii) 140-160 mm; (ix) 160-180 mm; (x) 180-200 mm; and (xi) >200 mm.

The collision, fragmentation or reaction device preferably comprises at least: (i) <10 electrodes; (ii) 10-20 electrodes: (iii) 20-30 electrodes; (iv) 30-40 electrodes; (v) 40-50 electrodes; (vi) 50-60 electrodes; (vii) 60-70 electrodes; (viii) 70-80 electrodes; (ix) 80-90 electrodes; (x) 90-100 electrodes; (xi) 100-110 electrodes; (xii) 110-120 electrodes; (xiii) 120-130 electrodes; (xiv) 130-140 electrodes; (xv) 140-150 electrodes; or (xvi) >150 electrodes.

According to an embodiment the mass spectrometer preferably further comprises a first mass filter or mass analyser arranged upstream of the collision, fragmentation or reaction device. The first mass filter or mass analyser is preferably selected from the group consisting of: (i) a quadrupole rod set mass filter; (ii) a Time of Flight mass filter or mass analyser; (iii) a Wein filter; and (iv) a magnetic sector mass filter or mass analyser.

According to an embodiment the mass spectrometer preferably further comprises a second mass filter or mass analyser arranged downstream of the collision, fragmentation or reaction device. The second mass filter or mass analyser is preferably selected from the group consisting of: (i) a quadrupole rod set mass filter; (ii) a Time of Flight mass filter or mass analyser; (iii) a Wein filter; and (iv) a magnetic sector mass filter or mass analyser.

According to an embodiment the mass spectrometer preferably further comprises means for driving or urging ions along and/or through at least a portion of the axial length of the collision, fragmentation or reaction device.

The means for driving or urging ions preferably comprises means for generating a linear axial DC electric field along at least 1%, 5%, 10%, 20%, 30%, 40%, 50%, 60%, 70%, 80%, 90%, 95% or 100% of the first section and/or the second section and/or the third section of the collision, fragmentation or reaction device or of the whole length of the collision, fragmentation or reaction device.

According to an embodiment the means for driving or urging ions comprises means for generating a non-linear or stepped axial DC electric field along at least 1%, 5%, 10%, 20%, 30%, 40%, 50%, 60%, 70%, 80%, 90%, 95% or 100% of the first section and/or the second section and/or the third section of the collision, fragmentation or reaction device or of the whole length of the collision, fragmentation or reaction device.

According to an embodiment the mass spectrometer further comprises means arranged and adapted to progressively increase, progressively decrease, progressively vary, scan, linearly increase, linearly decrease, increase in a stepped, progressive or other manner or decrease in a stepped, progressive or other manner the axial DC electric field maintained along at least 1%, 5%, 10%, 20%, 30%, 40%, 50%, 60%, 70%, 80%, 90%, 95% or 100% of the first section and/or the second section and/or the third section of the collision, fragmentation or reaction device or of the whole length of the collision, fragmentation or reaction device as a function of time.

According to another embodiment the means for driving or urging ions comprises means for applying a multiphase AC or RF voltage to at least 1%, 5%, 10%, 20%, 30%, 40%, 50%, 60%, 70%, 80%, 90%, 95% or 100% of the first section and/or the second section and/or the third section of the collision, fragmentation or reaction device or of the whole length of the collision, fragmentation or reaction device.

According to another embodiment the means for driving or urging ions comprises gas flow means which is arranged, in use, to drive or urge ions along and/or through at least 1%, 5%, 10%, 20%, 30%, 40%, 50%, 60%, 70%, 80%, 90%, 95% or 100% of the first section and/or the second section and/or the third section of the collision, fragmentation or reaction device or of the whole length of the collision, fragmentation or reaction device by gas flow or differential pressure effects.

According to a particularly preferred embodiment the means for driving or urging ions comprises means for applying one or more transient DC voltages or potentials or one or more DC voltage or potential waveforms to at least 1%, 5%, 10%, 20%, 30%, 40%, 50%, 60%, 70%, 80%, 90%, 95% or 100% of the electrodes of the first section and/or the second section and/or the third section of the collision, fragmentation or reaction device or of the electrodes forming the whole of the collision, fragmentation or reaction device.

The one or more transient DC voltages or potentials or one or more DC voltage or potential waveforms preferably create one or more potential hills, barriers or wells. The one or more transient DC voltage or potential waveforms preferably comprise a repeating waveform or square wave.

According to an embodiment in use a plurality of axial DC potential hills, barriers or wells are translated along at least 1%, 5%, 10%, 20%, 30%, 40%, 50%, 60%, 70%, 80%, 90%, 95% or 100% of the length of the first section and/or the second section and/or the third section of the collision, fragmentation or reaction device or of the whole length of the collision, fragmentation or reaction device, or a plurality of transient DC potentials or voltages are progressively applied to electrodes forming at least 1%, 5%, 10%, 20%, 30%, 40%, 50%, 60%, 70%, 80%, 90%, 95% or 100% of the first section and/or the second section and/or the third section of the collision, fragmentation or reaction device or of the whole length of the collision, fragmentation or reaction device.

According to an embodiment the Mass spectrometer further comprises first means arranged and adapted to progressively increase, progressively decrease, progressively vary, scan, linearly increase, linearly decrease, increase in a stepped, progressive or other manner or decrease in a stepped, progressive or other manner the amplitude, height or depth of the one or more transient DC voltages or potentials or the one or more DC voltage or potential waveforms.

The first means is preferably arranged and adapted to progressively increase, progressively decrease, progressively vary, scan, linearly increase, linearly decrease, increase in a stepped, progressive or other manner or decrease in a stepped, progressive or other manner the amplitude, height or depth of the one or more transient DC voltages or potentials or the one or more DC voltage or potential waveforms by $x_1$ Volts over a length $l_1$. According to an embodiment $x_1$ is preferably selected from the group consisting of: (i) <0.1 V; (ii) 0.1-0.2 V; (iii) 0.2-0.3 V; (iv) 0.3-0.4 V; (v) 0.4-0.5 V; (vi) 0.5-0.6 V; (vii) 0.6-0.7 V; (viii) 0.7-0.8 V; (ix) 0.8-0.9 V; (x) 0.9-1.0 V; (xi) 1.0-1.5 V; (xii) 1.5-2.0 V; (xiii) 2.0-2.5 V; (xiv) 2.5-3.0 V; (xv) 0.3.0-3.5 V; (xvi) 3.5-4.0 V; (xvii) 4.0-4.5 V; (xviii) 4.5-5.0 V; (xix) 5.0-5.5 V; (xx) 5.5-6.0 V; (xxi) 6.0-6.5 V; (xxii) 6.5-7.0 V; (xxiii) 7.0-7.5 V; (xxiv) 7.5-8.0 V; (xxv) 8.0-8.5 V; (xxvi) 8.5-9.0 V; (xxvii) 9.0-9.5 V; (xxviii) 9.5-10.0 V; and (xxix) >10.0 V. According to an embodiment $l_1$ is preferably selected from the group consisting of: (i) <10 mm; (ii) 10-20 mm; (iii) 20-30 mm; (iv) 30-40 mm; (v) 40-50 mm; (vi) 50-60 mm; (vii) 60-70 mm; (viii) 70-80 mm; (ix) 80-90 mm; (x) 90-100 mm; (xi) 100-110 mm; (xii) 110-120 mm; (xiii) 120-130 mm; (xiv) 130-140 mm; (xv) 140-150 mm; (xvi) 150-160 mm; (xvii) 160-170 mm; (xviii) 170-180 mm; (xix) 180-190 mm; (xx) 190-200 mm; and (xxi) >200 mm.

According to an embodiment the mass spectrometer further comprises second means arranged and adapted to progressively increase, progressively decrease, progressively vary, scan, linearly increase, linearly decrease, increase in a stepped, progressive or other manner or decrease in a stepped, progressive or other manner the velocity or rate at which the one or more transient DC voltages or potentials or the one or more DC potential or voltage waveforms are applied to the electrodes.

The second means is preferably arranged and adapted to progressively increase, progressively decrease, progressively vary, scan, linearly increase, linearly decrease, increase in a stepped, progressive or other manner or decrease in a stepped, progressive or other manner the velocity or rate at which the one or more transient DC voltages or potentials or the one or more DC voltage or potential waveforms are applied to the electrodes by $x_2$ m/s over a length $l_2$. According to an embodiment $x_2$ is selected from the group consisting of: (i) <1; (ii) 1-2; (iii) 2-3; (iv) 3-4; (v) 4-5; (vi) 5-6; (vii) 6-7; (viii) 7-8; (ix) 8-9; (x) 9-10, (xi) 10-11; (xii) 11-12; (xiii) 12-13; (xiv) 13-14; (xv) 14-15; (xvi) 15-16; (xvii) 16-17; (xviii) 17-18; (xix) 18-19; (xx) 19-20; (xxi) 20-30; (xxii) 30-40; (xxiii) 40-50; (xxiv) 50-60; (xxv) 60-70; (xxvi) 70-80; (xxvii) 80-90; (xxviii) 90-100; (xxix) 100-150; (xxx) 150-200; (xxxi) 200-250; (xxxii) 250-300; (xxxiii) 300-350; (xxxiv) 350-400; (xxx) 400-450; (xxxvi) 450-500; and (xxxvii) >500. According to an embodiment $l_2$ is selected from the group consisting of: (i) <10 mm; (ii) 10-20 mm; (iii) 20-30 mm; (iv) 30-40 mm; (v) 40-50 mm; (vi) 50-60 mm; (vii) 60-70 mm; (viii) 70-80 mm; (ix) 80-90 mm; (x) 90-100 mm; (xi) 100-110 mm; (xii) 110-120 mm; (xiii) 120-130 mm; (xiv) 130-140 mm; (xv) 140-150 mm; (xvi) 150-160 mm; (xvii) 160-170 mm; (xviii) 170-180 mm; (xix) 180-190 mm; (xx) 190-200 mm; and (xxi) >200 mm.

According to an embodiment the mass spectrometer further comprises third means arranged and adapted to progressively increase, progressively decrease, progressively vary, scan, linearly increase, linearly decrease, increase in a stepped, progressive or other manner or decrease in a stepped, progressive or other manner the amplitude of the first AC or RF voltage applied to the first group of electrodes as a function of time.

According to an embodiment the mass spectrometer further comprises fourth means arranged and adapted to progressively increase, progressively decrease, progressively vary, scan, linearly increase, linearly decrease, increase in a stepped, progressive or other manlier or decrease in a stepped, progressive or other manner the frequency of the first RF or AC voltage applied to the first group of electrodes as a function of time.

According to an embodiment the mass spectrometer further comprises fifth means arranged and adapted to progressively increase, progressively decrease, progressively vary, scan, linearly increase, linearly decrease, increase in a stepped, progressive or other manner or decrease in a stepped, progressive or other manner the amplitude of the second AC or RF voltage applied to the second group of electrodes as a function of time.

According to an embodiment the mass spectrometer further comprises sixth means arranged and adapted to progressively increase, progressively decrease, progressively vary, scan, linearly increase, linearly decrease, increase in a stepped, progressive or other manner or decrease in a stepped, progressive or other manner the frequency of the second RF or AC voltage applied to the second group of electrodes as a function of time.

According to an embodiment the mass spectrometer further comprises means for maintaining in a mode of operation the collision, fragmentation or reaction device at a pressure selected from the group consisting of: (i) $>1.0\times10^{-3}$ mbar; (ii) $>1.0\times10^{-2}$ mbar; (iii) $>1.0\times10^{-1}$ mbar; (iv) >1 mbar; (v) >10 mbar; (vi) >100 mbar; (vii) $>5.0\times10^{-3}$ mbar; (viii) $>5.0\times10^{-2}$ mbar; (ix) $10^{-4}$-$10^{-3}$ mbar; (x) $10^{-3}$-$10^{-2}$ mbar: and (xi) $10^{-2}$-$10^{-1}$ mbar.

In a mode of operation ions may be arranged to be trapped but are not substantially further fragmented or reacted within the collision, fragmentation or reaction device.

According to an embodiment the mass spectrometer may further comprise means for collisionally cooling or substantially thermalising ions within the collision, fragmentation or reaction device.

The mass spectrometer preferably further comprises one or more electrodes arranged at the entrance and/or exit of the collision, fragmentation or reaction device, wherein in a mode of operation ions are pulsed into and/or out of the collision, fragmentation or reaction device.

According to an embodiment the mass spectrometer further comprises an ion source. The ion source is preferably selected from the group consisting of: (i) an Electrospray ionisation ("EST") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (Xvi) a Nickel-63 radioactive ion source; and (xvii) a Thermospray ion source.

The ion source may comprise a continuous or pulsed ion source.

According to an embodiment the mass spectrometer may further comprise one or more ion guides or ion traps arranged upstream and/or downstream of the collision, fragmentation or reaction device.

The one or more ion guides or ion traps are preferably selected from the group consisting of:

(i) a multipole rod set or a segmented multipole rod set ion guide or ion trap comprising a quadrupole rod set, a hexapole rod set, an octapole rod set or a rod set comprising more than eight rods;

(ii) an ion tunnel or ion funnel ion guide or ion trap comprising a plurality of electrodes or at least 2, 5, 10, 20, 30, 40, 50, 60, 70, 80, 90 or 100 electrodes having apertures through which ions are transmitted in use, wherein at least 1%, 5%, 10%, 15%, 20%, 25%, 30%, 35%, 40%, 45%, 50%, 55%, 60%, 65%, 70%, 75%, 80%, 85%, 90%, 95% or 100% of the electrodes have apertures which are of substantially the same size or area or which have apertures which become progressively larger and/or smaller in size or in area;

(iii) a stack or array of planar, plate or mesh electrodes, wherein the stack or array of planar, plate or mesh electrodes comprises a plurality or at least 2, 3, 4, 5, 6, 7, 8, 9, 10, 11, 12, 13, 14, 15, 16, 17, 18, 19 or 20 planar, plate or mesh electrodes and wherein at least 1%, 5%, 10%, 15%, 20%, 25%, 30%, 35%, 40%, 45%, 50%, 55%, 60%, 65%, 70%, 75%, 80%, 85%, 90%, 95% or 100% of the planar, plate or mesh electrodes are arranged generally in the plane in which ions travel in use; and (iv) an ion trap or ion guide comprising a plurality of groups of electrodes arranged axially along the length of the ion trap or ion guide, wherein each group of electrodes comprises: (a) a first and a second electrode and means for applying a DC voltage or potential to the first and second electrodes in order to confine ions in a first radial direction within the ion guide; and (b) a third and a fourth electrode and means for applying an AC or RF voltage to the third and fourth electrodes in order to confine ions in a second radial direction within the ion guide.

The mass spectrometer preferably comprises a mass analyser. The mass analyser is preferably arranged downstream of the collision, fragmentation or reaction device. Less preferred embodiments are contemplated wherein the mass analyser may be provided upstream of the collision, fragmentation or reaction device.

The mass analyser is preferably selected from the group consisting of: (i) Fourier Transform ("FT") mass analyser; (ii) a Fourier Transform Ion Cyclotron Resonance ("FTICR") mass analyser; (iii) a Time of Flight ("TOF") mass analyser; (iv) an orthogonal acceleration Time of Flight ("oaTOF") mass analyser; (v) an axial acceleration Time of Flight mass analyser; (vi) a magnetic sector mass spectrometer; (vii) a Paul or 3D quadrupole mass analyser; (viii) a 2D or linear quadrupole mass analyser; (ix) a Penning trap mass analyser; (x) an ion trap mass analyser; (xi) a Fourier Transform orbitrap; (xii) an electrostatic Ion Cyclotron Resonance mass spectrometer; (xiii) an electrostatic Fourier Transform mass spectrometer; and (xiv) a quadrupole rod set mass filter or mass analyser.

According to another aspect of the present invention there is provided a method of mass spectrometry comprising:

providing a collision, fragmentation or reaction device, the collision, fragmentation or reaction device comprising a plurality of electrodes comprising at least a first section comprising a first group of electrodes and a second separate section comprising a second separate group of electrodes;

applying or supplying a first AC or RF voltage having a first frequency and a first amplitude to the first group of electrodes so that ions having a first mass to charge ratio experience a first radial pseudo-potential electric field or force having a first strength or magnitude which acts to confine ions radially within the first group of electrodes or the first section; and applying or supplying a second AC or RF voltage having a second frequency and a second amplitude to the second group of electrodes so that ions having the first mass to charge ratio experience a second radial pseudo-potential electric field or force having a second strength or magnitude which acts to confine ions radially within the second group of electrodes or the second section, wherein the second strength or magnitude is different to the first strength or magnitude.

According to another aspect of the present invention there is provided a mass spectrometer comprising:

a collision, fragmentation or reaction device comprising at least a first section and a second separate section;

wherein the collision, fragmentation or reaction is arranged and adapted so that ions having a first mass to charge ratio experience a first radial pseudo-potential electric field or force within the first section and experience a second different radial pseudo-potential electric iconic field or force within the second section.

According to another aspect of the present invention there is provided a method of mass spectrometry comprising:

providing a collision, fragmentation or reaction device, the collision, fragmentation or reaction device comprising at least a first section and a second separate section;

arranging for ions having a first mass to charge ratio to experience a first radial pseudo-potential electric field or force within the first section; and arranging for ions having the first mass to charge ratio to experience a second different radial pseudo-potential electric field or force within the second section.

According to another aspect of the present invention there is provided a mass spectrometer comprising:

a collision, fragmentation or reaction device comprising a plurality of electrodes, wherein an aspect ratio of the electrodes varies along the length of the collision, fragmentation or reaction device; and wherein ions having a first mass to charge ratio experience, in use, a radial pseudo-potential electric field or force which varies along the length of the collision, fragmentation or reaction device.

According to an embodiment the internal diameter of apertures in the electrodes may progressively increase, progressively decrease, linearly increase, linearly decrease, increase in a stepped, progressive or other manner, decrease in a stepped, progressive or other manner, increase in a non-linear manner or decrease in a non-linear manner along the axial length of the collision, fragmentation or reaction device. Alternatively/additionally, the axial thickness of the electrodes may progressively increase, progressively decrease, linearly increase, linearly decrease, increase in a stepped, progressive or other manner, decrease in a stepped, progressive or other manner, increase in a non-linear manner or decrease in a non-linear manner along the axial length of the collision, fragmentation or reaction device. Alternatively/additionally, the axial spacing between electrodes may progressively increase, progressively decrease, linearly increase, linearly decrease, increase in a stepped, progressive or other manner, decrease in a stepped, progressive or other manner, increase in a non-linear manner or decrease in a non-linear manner along the axial length of the collision, fragmentation or reaction device.

According to another aspect of the present invention there is provided a method of mass spectrometry comprising:

providing a collision, fragmentation or reaction device comprising a plurality of electrodes, wherein an aspect ratio of the electrodes varies along the length of the collision, fragmentation or reaction device; and wherein ions having a first mass to charge ratio experience a radial pseudo-potential electric field or force which varies along the length of the collision, fragmentation or reaction device.

According to an embodiment the internal diameter of apertures in the electrodes may progressively increase, progressively decrease, linearly increase, linearly decrease, increase in a stepped, progressive or other manner, decrease in a stepped, progressive or other manner, increase in a non-linear manner or decrease in a non-linear manner along the axial length of the collision, fragmentation or reaction device. Alternatively/additionally, the axial thickness of the electrodes may progressively increase, progressively decrease, linearly increase, linearly decrease, increase in a stepped, progressive or other manner, decrease in a stepped, progressive or other manner, increase in a non-linear manner or decrease in a non-linear manner along the axial length of the collision, fragmentation or reaction device. Alternatively/additionally, the axial spacing between electrodes may progressively increase, progressively decrease, linearly increase, linearly decrease, increase in a stepped, progressive or other manner, decrease in a stepped, progressive or other manner, increase in a non-linear manner or decrease in a non-linear manner along the axial length of the collision, fragmentation or reaction device.

According to another aspect of the present invention there is provided a mass spectrometer comprising:

a collision, fragmentation or reaction device wherein ions having a first mass to charge ratio experience, in use, a radial pseudo-potential electric field or force which progressively increases, progressively decreases, linearly increases, linearly decreases, increases in a stepped, progressive or other manner, decreases in a stepped, progressive or other manner, increases in a non-linear manner or decreases in a non-linear manner along the axial length of the collision, fragmentation or reaction device.

According to another aspect of the present invention there is provided a method of mass spectrometry comprising:

providing a collision, fragmentation or reaction device wherein ions having a first mass to charge ratio experience a radial pseudo-potential electric field or force which progressively increases, progressively decreases, linearly increases, linearly decreases, increases in a stepped, progressive or other manner, decreases in a stepped, progressive or other manner, increases in a non-linear manner or decreases in a non-linear manner along the axial length of the collision, fragmentation or reaction device.

According to another aspect of the present invention there is provided a mass spectrometer comprising:

a collision, fragmentation or reaction device wherein ions experience, in use, a radial pseudo-potential electric field or force which varies along at least 1%, 5%, 10%, 15%, 20%, 25%, 30%, 35%, 40%, 45%, 50%, 55%, 60%, 65%, 70%, 75%, 80%, 85%, 90%, 95% or 100% of the axial length of the collision, fragmentation or reaction device.

According to another aspect of the present invention there is provided a method of mass spectrometry comprising:

providing a collision, fragmentation or reaction device wherein ions experience a radial pseudo-potential electric field or force which varies along at least 1%, 5%, 10%, 15%, 20%, 25%, 30%, 35%, 40%, 45%, 50%, 55%, 60%, 65%, 70%, 75%, 80%, 85%, 90%, 95% or 100% of the axial length of the collision, fragmentation or reaction device.

According to another aspect of the present invention there is provided a mass spectrometer comprising:

a collision, fragmentation or reaction device wherein ions having a first mass to charge ratio experience, in use, a first non-zero radial pseudo-potential electric field or force at a first time and a second different non-zero radial pseudo-potential electric field or force at a second later time.

According to another aspect of the present invention there is provided a method of mass spectrometry comprising:

providing a collision, fragmentation or reaction device wherein ions having a first mass to charge ratio experience a first non-zero radial pseudo-potential electric field or force at a first time and a second different non-zero radial pseudo-potential electric field or force at a second later time.

According to another aspect of the present invention there is provided a mass spectrometer comprising:

a collision, fragmentation or reaction device comprising a first section and a second section; and means arranged and adapted to progressively increase, progressively decrease, progressively vary, scan, linearly increase, linearly decrease, increase in a stepped, progressive or other manner or decrease in a stepped, progressive or other manner a radial pseudo-potential electric field or force maintained along at least 1%, 5%, 10%, 20%, 30%, 40%, 50%, 60%, 70%, 80%, 90%, 95% or 100% of said first section and/or said second section or of the whole length of said collision, fragmentation or reaction device as a function of time.

According to another aspect of the present invention there is provided a method of mass spectrometry comprising:

providing a collision, fragmentation or reaction device comprising a first section and a second section; and progressively increasing, progressively decreasing, progressively varying, scanning, linearly increasing, linearly decreasing, increasing in a stepped, progressive or other manner or decreasing in a stepped, progressive or other manner a radial pseudo-potential electric field or force maintained along at least 1%, 5%, 10%, 20%, 30%, 40%, 50%, 60%, 70%, 80%, 90%, 95% or 100% of said first section and/or said second section or of the whole length of said collision, fragmentation or reaction device as a function of time.

The further preferred features described above in relation to other aspects of the present invention are equally applicable to all other aspects of the present invention as described above.

The preferred embodiment relates to a gas collision cell which preferably comprises an AC or RF ion guide. The gas collision cell is preferably arranged to receive parent or precursor ions. Two or more different AC or RF voltages are preferably applied to electrodes forming the AC or RF ion guide at two or more different locations along the length of the AC or RF ion guide in order to optimise the radial confinement of both parent and resulting fragment ions.

According to a preferred embodiment the AC or RF ion guide which forms the gas collision cell may be divided into at least two different segments or sections wherein a different AC or RF voltage is applied to the different segments or sections. The separate segments or sections may have the same length or may alternatively be of unequal length.

According to a preferred embodiment the AC or RF voltage and frequency applied to the electrodes of the AC or RF ion guide at the entrance region of the gas collision cell is preferably arranged to ensure that the parent or precursor ions are transmitted into the gas collision cell with optimum efficiency. Similarly, the AC or RF voltage and frequency applied to the electrodes of the AC or RF ion guide at the exit region of the gas collision cell is preferably arranged to ensure that product or fragment ions formed within the gas collision cell can be transmitted to the exit of the gas collision cell with optimum efficiency.

Parent or precursor ions enter a gas collision cell and product or fragment ions exit the gas collision cell but it is not known precisely at what point along the length of the gas collision cell the transition takes place. It is likely that different parent or precursor ions fragment into product or fragment ions at different points along the length of the gas collision cell. In some instances parent or precursor ions will fragment into first generation product or fragment ions at a first point along the length of the gas collision cell and then the first generation product or fragment ions will in turn fragment into second generation product or fragment ions at a second different point further along the length of the gas collision cell.

It is believed that many parent or precursor ions travel a substantial distance along the length of a gas collision cell and undergo multiple collisions before they are sufficiently heated (i.e. that their internal energy is sufficiently increased) so as to be induced to fragment.

According to the preferred embodiment the first and second AC or IV voltage and frequency are preferably set such that parent or precursor ions are arranged to be transmitted in a substantially optimum manner along a substantial length of the gas collision cell after they have entered into the gas collision cell.

It is generally the case that the kinetic energy of product or fragment ions when first formed is relatively high e.g. a few electron-volts. However, it is also usually desirable to cool the product or fragment ions (i.e. reduce their kinetic energy and energy spread) before they exit the gas collision cell. This can help to improve the performance of a mass analyser arranged downstream of the gas collision cell and which is used to analyse the product or fragment ions which emerge from the gas collision cell. Therefore, the experimental conditions are usually arranged such that the product or fragment ions are formed some distance before the exit of the gas collision cell so that they may be collisionally cooled prior to exiting the gas collision cell. Ideally the product ions are thermalised (i.e. their kinetic energies are reduced to that of the bath gas) by the time they exit the gas collision cell.

According to the preferred embodiment the first and second AC or RF voltage and frequency are preferably set such that product or fragment ions are arranged to be transmitted in a substantially optimum manner along an adequate length of the gas collision cell before they exit from the gas collision cell.

According to an embodiment two separate AC or RF voltages may be provided along the length of the gas collision cell in order to optimise the yield of product or fragment ions emerging from the gas collision cell. However, in some instances further advantage may be gained by arranging for three or more AC or RF voltages to be applied over different regions along the length of the gas collision cell.

According to a less preferred embodiment the AC or RF voltage applied to electrodes forming the gas collision cell may progressively change from that optimised for the transmission of parent or precursor ions at the entrance region of the gas collision cell to that optimised for the transmission of product or fragment ions at the exit from the has collision cell.

According to an embodiment three or more groups of electrodes or segments may be provided along the length of the gas collision cell. A first AC or RF voltage may be applied to a first group of electrodes or segment and a second AC or RF voltage may be applied to second and further groups of electrodes or segments. For example, the RV ion guide may be arranged into four equal length segments wherein a first AC or RF voltage is applied to the first segment and a second AC or RF voltage is applied to the second, third and fourth segments.

According to another embodiment a first AC or RF voltage may be applied to the first and second segments and a second AC or RF voltage may be applied to the third and fourth segments.

According to another embodiment a first AC or RF voltage may be applied to the first, second and third segments and a second AC or RF voltage may be applied to the fourth segment.

The various embodiments enable the position along the length of the gas collision cell at which the RF voltage changes from one to another to be optimised such as to maximise the yield of product or fragment ions exiting the gas collision cell.

This approach may be extended such that according to another embodiment three or more different AC or RF voltages may be applied to groups of electrodes along the length of the gas collision cell. The positions along the length of the gas collision cell at which the three or more AC or RF voltages are changed may be optimised such as to maximise the yield of product or fragment ions exiting the gas collision cell.

According to a particularly preferred embodiment the radial confining pseudo-potential electric field maintained along one or more sections of the collision, fragmentation or reaction device may be altered during use.

The different segments of the RF ion guide may be of equal or unequal length.

According to a particularly preferred embodiment the gas collision cell may comprise a ring stack or ion tunnel ion guide wherein an AC or RF voltage is applied between neighbouring rings. One or more DC voltage gradients may be applied along the whole or a substantial length of the gas collision cell in order to urge ions in one direction preferably from the entrance region to the exit region of the gas collision cell. Alternatively, or in addition, one or more transient DC voltages or potentials or one or more transient DC voltage or potential waveforms may be applied to the electrodes forming the gas collision cell or may be superimposed on the electrodes in order to urge ions in one direction, preferably from the entrance region to the exit region of the gas collision cell.

The one or more transient DC voltages or potentials or one or more transient DC voltage or potential waveforms preferably comprise a series or one or more transient DC voltages or potentials applied to specific rings or electrodes at regular intervals along the length of the gas collision cell and which are preferably periodically shifted to neighbouring rings or electrodes such as to urge ions in the direction in which the one or more transient DC voltages or potentials are shifted. The rings or electrodes may be divided or grouped into two or more groups such that the RF voltage applied to each ring or electrode in each group is the same but is different to that applied to the rings or electrodes in different groups.

An advantage of using an RF ring stack or ion tunnel ion guide is that the ion guide can relatively easily be divided into a number of separate axial sections. Different AC or RF voltages can therefore be applied to different sections along the length of the gas collision cell.

Embodiments are contemplated wherein the AC or RF voltage applied to each individual ring or electrode may be different. According to this embodiment the AC or RF voltage applied to the electrodes may vary continuously along the length of the ion guide. The AC or RF voltage may vary linearly or non-linearly along the length of the ion guide or gas collision cell.

It should be noted that at the position along the axis of the ion guide at which the magnitude of the AC or RF electric field changes ions passing through that region will, in effect, experience an axial force in the direction towards the weaker AC or RF electric field. This is another manifestation of the time-averaged force experienced by mobile charged particles in the presence of an inhomogeneous RF field. This may be referred to as a pseudo-force arising from a pseudo-potential difference. The pseudo-potential difference is dependent upon the mass to charge ratio of the ion, and the smaller the mass to charge ratio the greater the pseudo-potential difference.

In most instances the mass to charge ratio of the product or fragment ion will be less than that of the parent or precursor ion and hence the optimum Rh field at the exit of the gas collision cell will preferably be less than that at the entrance of the gas collision cell. Therefore, in these instances the ions will preferably experience an axial force which preferably propels the ions forwards towards the exit of the gas collision cell as a result of the change in magnitude of the AC or RF electric field along the length of the gas collision cell. In general, this is a further advantage of IC the preferred embodiment since the background gas present in the gas collision cell will normally slow the movement of ions such that the transit time of ions may become excessively long. Advantageously, the pseudo-force resulting from the reduction in RF field strength will accelerate the ions towards the exit of the gas collision cell and hence will help to reduce the transit time of ions through the gas collision cell.

In an embodiment wherein a stacked ring or ion tunnel ion guide is provided and wherein the AC or RF voltage applied to each individual ring or electrode is different (thereby allowing the AC or RF voltage to reduce continuously along the length of the collision cell) the ions will experience a continuous pseudo-force accelerating them towards the exit region of the gas collision cell. The pseudo-force will act on the ions continuously as they move along the length of the collision cell.

It is possible for the mass to charge ratio of product or fragment ions to be greater than that of the corresponding parent or precursor ion. For example, a parent or precursor ion may combine or react with a buffer gas molecule to yield a product or adduct ion having a higher mass to charge ratio than that of the parent or precursor ion. Alternatively, the parent or precursor ion may be multiply charged and the fragment ion may have a lower mass, a lower charge state and a higher mass to charge ratio. In these instances the AC or RF electric field at the exit region of the gas collision cell may be greater than that at the entrance region of the collision cell. According to this embodiment the ions may pass from a region of relatively low AC or RF electric field strength to a region of relatively high AC or RF electric field strength and therefore experience a pseudo-force winch acts against the ions. In this case an additional means may be provided to propel the ions towards the exit region of the gas collision cell. According to one embodiment a DC voltage gradient may be applied over regions where the RF field strength changes or throughout the whole length of the gas collision cell such as to accelerate ions towards the exit region of the gas collision cell. Alternatively, one or more transient DC voltages or potentials or one or more transient DC voltage or potential waveforms may be superimposed on the electrodes forming the collision cell such as to propel ions towards the exit region of the gas collision cell.

According to another less preferred embodiment the AC or RF electric field strength may be changed at one or more positions along the length of the gas collision cell by changing the mechanical dimensions of the electrodes to which the AC or RF voltage is applied. For example, in the case of a ring stack ion guide the AC or RF electric field strength may be reduced by increasing the internal diameter of the electrode apertures and/or by increasing the spacing between electrodes for the same applied RF voltage.

According to another embodiment packets of ions rather than a continuous beam of ions may be received at the collision cell. The AC or RF voltage applied to the collision cell may be reduced as the packet of ions passes through the collision cell. If a number of ions having the same mass to charge ratio enter the gas collision cell at substantially the same time with substantially the same energy then they will travel substantially together through the gas collision cell. Many of the parent ions will fragment at approximately the same position along the length of the gas collision cell and at approximately the same time. The AC or RF voltage applied to the gas collision cell may be arranged to change in magnitude at a time to coincide with the time at which the parent or precursor ions are predicted to fragment.

Alternatively, the AC or RF voltage may be arranged to change continuously as the ions pass along the length of the gas collision cell. The AC or RF voltage may be arranged to change discontinuously or continuously, linearly or non-linearly, during the ion transit time.

According to an embodiment the AC or RF voltage may change continuously and non-linearly when the parent or precursor ions may fragment into many different first generation fragment ions which may further fragment into several different species of second generation fragment ions.

The ions arriving at the gas collision cell may arrive in bursts or packets if a discontinuous ion source such as a MALDI ion source, a Laser Desorption and Ionisation ion source, or a DIOS (Desorption and Ionisation on Silicon) ion source or other Laser Ablation ion source is used in conjunction with the collision cell. Alternatively, ions from a continuous or discontinuous ion source may be accumulated in a trapping region positioned preferably upstream of the gas collision cell. The ions may then be released in a burst or packet into the gas collision cell. The AC or RF voltage applied to the gas collision cell ion guide is preferably stepped or scanned in synchronism with the passage of ions through the gas collision cell.

According to another embodiment the AC or RF ion guide may comprise a stack of flat plates with their plane normal to the axis of the ion guide wherein an AC or RF voltage is applied between neighbouring plates. The AC or RF ion guide is divided into a plurality of elements or axial sections which allows different AC or RF voltages to be applied to different sections along the length of the gas collision cell.

According to a less preferred embodiment the AC or RF ion guide may comprise a segmented multi-pole rod set ion guide such as a quadrupole, hexapole or octopole rod set ion guide. The rod set ion guide is preferably segmented along its length such that different AC or RF voltages are applied to different segments of the AC or RF ion guide.

According to another less preferred embodiment the AC or RF ion guide may comprise a segmented flat plate ion guide wherein the plates are preferably arranged in a sandwich formation with the plane of the plates parallel to the axis of the ion guide. AC or RF voltages are preferably applied between neighbouring plates. The plates are preferably segmented along their length such that different AC or RF voltages may be applied to different segments of the AC or RF ion guide.

BRIEF DESCRIPTION OF THE DRAWINGS

Various embodiments of the present invention will now be described, by way of example only, and with reference to the accompanying drawings in which.

DETAILED DESCRIPTION OF THE PREFERRED EMBODIMENTS

Figure 1:
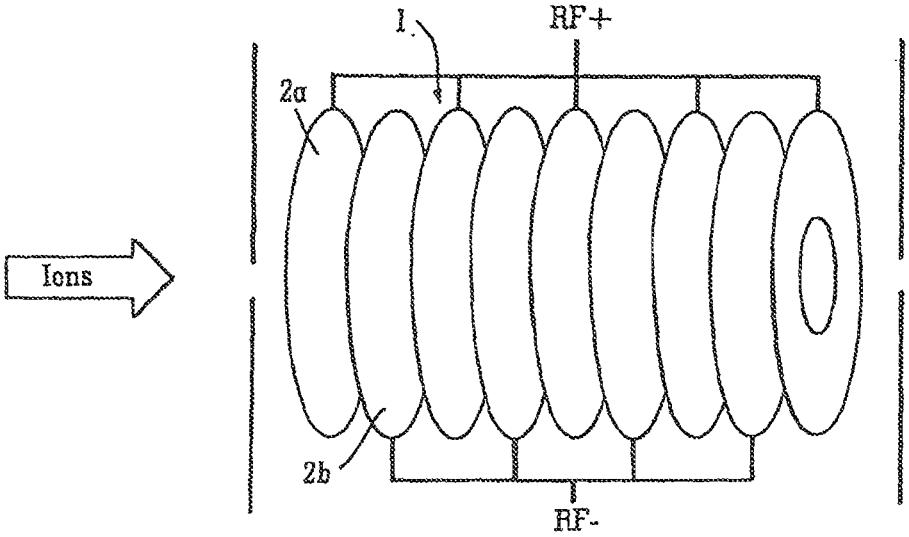
FIG. 1 PRIOR ART
FIG. 1 shows an example of a known RF ion guide comprising a ring stack or ion tunnel assembly.

A preferred embodiment of the present invention will now be described. FIG. 1 shows for illustrative purposes only an RF ion guide comprising a ring or ion tunnel stack assembly 1. The ion guide comprises a stack of ring electrodes 2*a*,2*b*. Opposite phases of an AC or RF voltage are applied to axially adjacent electrodes 2*a*,2*b*.

The electrodes are approximately 0.5 mm thick and have an axial centre to centre spacing in the range 1 to 1.5 mm. The inner aperture of the ring electrodes may be in the range 4 mm to 6 mm diameter.

The frequency of the AC or RF voltage is in the range 300 kHz to 3 MHz and the AC or RF voltage has an amplitude in the range of 500-1000 V peak to peak. The optimum, amplitude of the AC or RF voltage depends upon the exact dimensions of the assembly, the frequency of the AC or RF voltage and the mass to charge ratio of the ions being transmitted.

Figure 2:
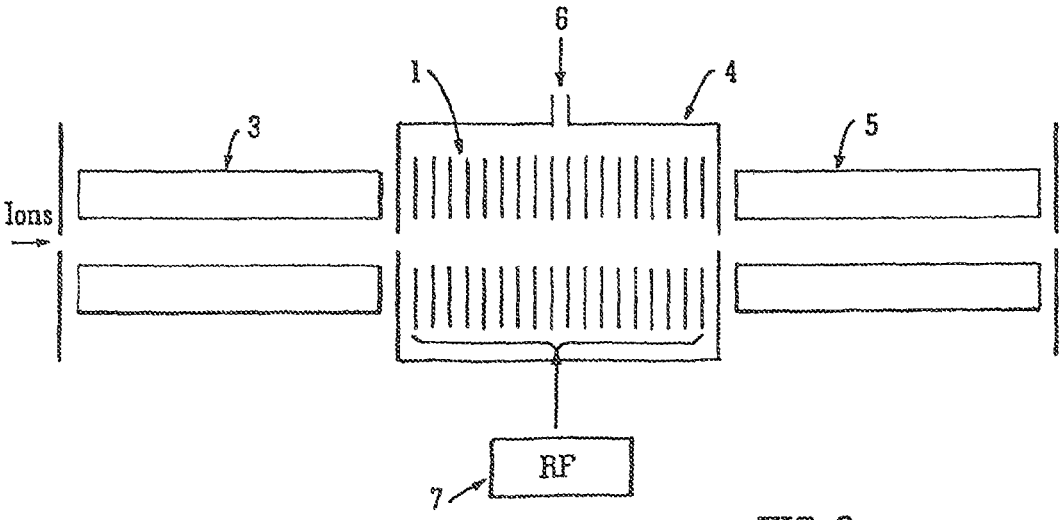
FIG. 2 PRIOR ART
FIG. 2 shows a known triple quadrupole arrangement comprising a first quadrupole mass filter, a gas collision cell and a second quadrupole mass filter.

FIG. 2 shows a known tandem quadrupole mass spectrometer or triple quadrupole arrangement. The known arrangement comprises a first quadrupole mass filter 3, a gas collision cell 4 and a second quadrupole mass filter 5. The gas collision cell 4 comprises an RF ring stack or ion tunnel ion guide 1 provided in a housing 4. A means 6 is provided for introducing gas into the gas collision cell 4. Ions passing through the gas collision cell 4 are arranged to undergo collision induced decomposition resulting in a plurality of fragment or daughter ions being generated or formed in the collision cell 4.

The ring stack or ion tunnel ion guide 1 located within the gas collision cell 4 is supplied with a single AC or RF voltage by an AC or RF generator 7. Ions from an ion source (not shown) are transmitted to the first quadrupole mass filter 3. The first quadrupole mass filter 3 is arranged to transmit parent or precursor ions having a particular or desired mass to charge ratio and to attenuate all other ions having different or undesired mass to charge ratios. The parent or precursor ions selected by the first quadrupole mass filter 3 are onwardly transmitted to the gas collision cell 4. As parent or precursor ions enter the gas collision cell 4 they experience multiple energetic collisions. The parent or precursor ions are induced to fragment into fragment or daughter ions. The resulting fragment or daughter ions leave the gas collision cell 4 and are onwardly transmitted to the second quadrupole mass filter 5. Daughter or fragment ions having a particular mass to charge ratio are onwardly transmitted by the second quadrupole mass filter 5. The ions which are onwardly transmitted by the second quadrupole mass filter 5 are then detected by an ion detector (not shown).

Figure 3:
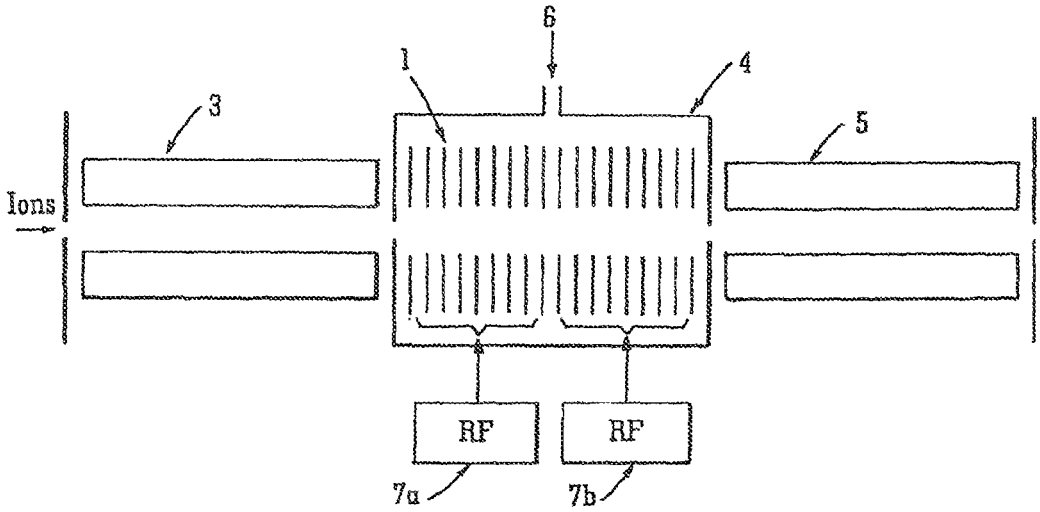
FIG. 3 shows a preferred embodiment of the present invention comprising a first quadrupole mass filter, a gas collision cell and a second quadrupole mass filter, wherein the gas cell is divided into two segments or sections and the amplitude of the RF voltage applied to each segment is different.

FIG. 3 shows a triple quadrupole or tandem mass spectrometer according to a preferred embodiment of the present invention. According to the preferred embodiment a ring stack or ion tunnel ion guide 1 is located within a gas collision cell 4. A first upstream group of electrodes of the ion guide 1 are supplied with a first AC or RF voltage which is supplied by a first AC or RF generator 7*a* and a second downstream group of electrodes are supplied with a second AC or RF voltage which is supplied by a second separate AC or RF generator 7*b*.

The first AC or RF voltage is preferably arranged to have a frequency and an amplitude which ensures that parent or precursor ions which have been selected by the first quadrupole mass filter 3 are transmitted into the upstream portion or section of the gas collision cell 4 and are radially confined within the gas collision cell 4 in a substantially optimum manner.

The second AC or RF voltage is preferably arranged to have a frequency and an amplitude which ensures that fragment or daughter ions which are formed or created within the gas collision cell 4 are preferably transmitted through the downstream portion of the gas collision cell 4 and are radially confined within the gas collision cell 4 in a substantially optimum manner so that the fragment or daughter ions are then preferably onwardly transmitted to the second quadrupole mass filter 5 or other ion-optical device.

According to an alternative embodiment the first and second AC or RF voltages applied to the electrodes of the ion guide 1 may be generated from a single RF generator. A first output from the RF generator may be supplied substantially unattenuated to the first upstream group of electrodes. A second output from the RF generator may be arranged to pass through an attenuator to reduce the amplitude of the AC or RF voltage. The reduced amplitude AC or RF voltage is preferably applied to the second downstream group of electrodes.

According to an embodiment the two segments or sections of the RF ion guide 1 (Or collision, fragmentation or reaction device) may be arranged to have the same length or may alternatively be arranged to be of different lengths.

By way of illustration, parent or precursor ions having a mass to charge ratio of, for example, 600 may be arranged to enter the gas collision cell 4. A first AC or RF voltage having an amplitude of 200V peak to peak may be applied to a first upstream group of electrodes. Fragment ions having a mass to charge ratio of for example, 195 may be formed with the gas collision cell 4 and a second AC or RF voltage having a lower amplitude of 100V peak to peak may be applied to the second downstream group of electrodes. In this way, the parent or precursor ions are received and are radially confined in a substantially optimum manner. Similarly, the fragment or daughter ions which are formed approximately half way along the length of the gas collision cell 4 are onwardly transmitted to the exit of the as collision cell 4 whilst also being radially confined in a substantially optimum manner.

Figure 4:
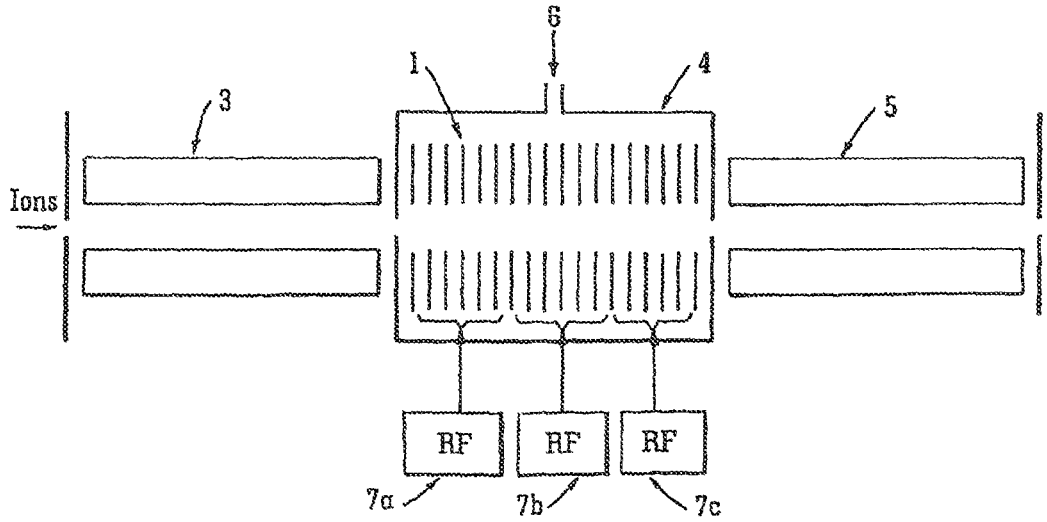
FIG. 4 shows another embodiment of the present invention comprising a first quadrupole mass filter, a gas collision cell and a second quadrupole mass filter, wherein the gas cell is divided into three segments or sections and the amplitude of the RF voltage applied to each segment or section is different.

FIG. 4 shows another embodiment of the present invention wherein three separate AC or RF generators 7*a*,7*b*,7*c* are used to provide three different AC or RF voltages to the electrodes forming the ion guide 1 provided with the gas collision cell 4.

The first AC or RF generator 7*a* is preferably arranged to supply a first AC or RF voltage to a first upstream group of electrodes forming the ion guide 1. The first AC or RF voltage is preferably arranged to ensure that parent or precursor ions which have been selected by the first quadrupole mass filter 3 are transmitted into an upstream region of the gas collision cell 4 in a substantially optimum manner.

The third AC or RF generator 7*c* is preferably arranged to supply a third AC or RF voltage to a third downstream group of electrodes forming the ion guide 1. The third AC or RF voltage is preferably arranged to ensure that fragment or daughter ions which have been produced or created within the gas collision cell 4 are preferably onwardly transmitted from the gas collision, cell 4 to the second quadrupole mass filter 5 (or other ion-optical device) in a substantially optimum manner.

The second AC or RF generator 7*b* is preferably arranged to supply a second AC or RF voltage to a second intermediate group of electrodes forming the ion guide 1. The amplitude and/or the frequency of the second AC or RF voltage is preferably intermediate the amplitude and/or frequency of the first AC or RF voltage as supplied by the first AC or RF generator 7*a* to the upstream group of electrodes and the amplitude and/or the frequency of the third AC or RF voltage as supplied by the third AC or RF generator 7*c* to the third downstream group of electrodes.

According to an embodiment the amplitude and/or frequency of the second AC or RF voltage may be adjusted in order to optimise the yield of fragment or daughter ions leaving the gas collision cell 4. The lengths of the different segments of the RF ion guide 1 or the lengths of the first and/or second and/or third groups of electrodes may or may not be the same.

Although the present invention has been described with reference to preferred embodiments, it will be understood by those skilled in the art that various changes in form and detail may be made to the preferred embodiments discussed above without departing from the scope of the invention as set forth in the accompanying claims.

The invention claimed is:

1. A method of mass spectrometry comprising:

providing a collision cell;

receiving packets of parent ions at the collision cell;

applying an AC or RF voltage to the collision cell; and wherein the magnitude of the AC or RF voltage is reduced as the packet of ions passes through the collision cell and at a time to coincide with the time at which the parent or precursor ions are predicted to fragment.

2. A method as claimed in claim 1, wherein ions having the same mass to charge ratio enter the gas collision cell at substantially the same time with substantially the same energy.

3. A method as claimed in claim 1, wherein parent ions fragment at approximately the same position along the length of the gas collision cell and at approximately the same time.

4. A method as claimed in claim 1, wherein ions of a first mass to charge ratio experience a first non-zero radial pseudo-potential electric field or force at a first time and a second different non-zero radial pseudo-potential electric field or force at a second later time.

5. A mass spectrometer comprising:

a collision cell arranged to receive packets of parent ions;

means to apply an AC or RF voltage to the collision cell; and control means to reduce the magnitude of the AC or RF voltage as the packet of ions passes through the collision cell and at a time to coincide with the time at which the parent or precursor ions are predicted to fragment.

6. A method as claimed in claim 5, wherein ions having a first mass to charge ratio experience, in use, a first non-zero radial pseudo-potential electric field or force at a first time and a second different non-zero radial pseudo-potential electric field or force at a second later time.

* * * * *